US010907344B2

(12) United States Patent
Jung

(10) Patent No.: US 10,907,344 B2
(45) Date of Patent: Feb. 2, 2021

(54) LIGHTWEIGHT WALL BODY FRAME

(71) Applicant: DASAN P&G CO,. LTD., Paju-si (KR)

(72) Inventor: Han-Seul Jung, Seoul (KR)

(73) Assignee: DASAN P&G CO,. LTD., Paju-si (KR)

( * ) Notice: Subject to any disclaimer, the term of this patent is extended or adjusted under 35 U.S.C. 154(b) by 0 days.

(21) Appl. No.: 16/035,727

(22) Filed: Jul. 16, 2018

(65) Prior Publication Data

US 2018/0328020 A1 Nov. 15, 2018

Related U.S. Application Data

(63) Continuation of application No. PCT/KR2017/000555, filed on Jan. 17, 2017.

(30) Foreign Application Priority Data

Jan. 18, 2016 (KR) ..... 10-2016-0005971

(51) Int. Cl.

| | |
|---|---|
| ***E04B 1/38*** | (2006.01) |
| ***E04B 2/74*** | (2006.01) |
| ***E04B 2/78*** | (2006.01) |

(52) U.S. Cl.

CPC ..... *E04B 1/38* (2013.01); *E04B 2/7457* (2013.01); *E04B 2/78* (2013.01); *E04B 2/7455* (2013.01);

(Continued)

(58) Field of Classification Search

CPC . E04B 1/38; E04B 2/7457; E04B 2/78; E04B 2002/7498; E04B 2002/749; E04B 2/7455

See application file for complete search history.

(56) References Cited

U.S. PATENT DOCUMENTS 5,592,794 A * 1/1997 Tundaun ..... E04B 1/6162 52/220.7
D417,290 S * 11/1999 Goleby ..... D25/122

(Continued)

FOREIGN PATENT DOCUMENTS

CN 1110739 A 10/1995
CN 202227551 A 5/2012

(Continued)

OTHER PUBLICATIONS

Office Action dated Apr. 15, 2019 from Japanese Patent Office for JPA 2019-556777.

(Continued)

*Primary Examiner* — Basil S Katcheves
*Assistant Examiner* — Omar F Hijaz

(57) ABSTRACT

Various embodiments regarding a lightweight wall body frame used for a clean room are described. According to an embodiment, a lightweight wall body frame may comprise: a frame body; a coupling portion comprising a coupling opening formed at the center portion of the frame body; first and second attachment surfaces formed on the outer surface of the frame body so as to attach a steel plate of the lightweight wall body; and first and second support portions formed inside the frame body and inclined so as to connect between the coupling portion and the first and second attachment surfaces and to support the same. Besides, various other embodiments are possible.

17 Claims, 7 Drawing Sheets

(52) U.S. Cl.
CPC . *E04B 2002/749* (2013.01); *E04B 2002/7498* (2013.01)

(56) References Cited

U.S. PATENT DOCUMENTS

| | | | | |
|---|---|---|---|---|
| 9,151,045 | B2 * | 10/2015 | Huang | E04B 2/7401 |
| 2011/0192555 | A1 | 8/2011 | Frezouls et al. | |

FOREIGN PATENT DOCUMENTS

| | | | | | |
|---|---|---|---|---|---|
| DE | 1956741 | U | | 3/1967 | |
| EP | 0675240 | A1 | | 10/1995 | |
| EP | 2360322 | A1 | | 8/2011 | |
| FR | 2799481 | A1 | | 4/2001 | |
| FR | 2956134 | A | | 8/2011 | |
| JP | 60-133023 | U | | 9/1985 | |
| JP | S63-85717 | A | | 6/1988 | |
| JP | H10-266455 | A | | 10/1998 | |
| JP | 2000-352148 | A | | 12/2000 | |
| JP | 2001012009 | A | * | 1/2001 | E04B 1/615 |
| JP | 2001-329623 | A | | 11/2001 | |
| JP | 2008-121357 | A | | 5/2008 | |
| JP | 2009-159944 | A | | 7/2009 | |
| KR | 20-1998-0015157 | U | | 6/1998 | |
| KR | 20-0254577 | Y1 | | 12/2001 | |
| KR | 10-2006-0039186 | A | | 5/2006 | |
| KR | 20-2009-0005267 | U | | 6/2009 | |
| KR | 20-2009-0012506 | U | | 12/2009 | |
| WO | 2015/118588 | A1 | | 8/2015 | |
| WO | WO-2015118588 | A1 | * | 8/2015 | E04B 1/615 |

OTHER PUBLICATIONS

The extended European Search Report for European Application No. 17741626.0 dated Dec. 19, 2018.
International Search Report dated Apr. 13, 2017 for PCT/KR2017/000555 and its English translation.
Office Action dated Sep. 4, 2019 from Chinese Patent Office for 2017/80007215.8.
An office action dated Dec. 14, 2020 from Japanese Patent Office for Japanese Application No. 2018-556777.

* cited by examiner

LIGHTWEIGHT WALL BODY FRAME

PRIORITY

This application is continuation of International Application No. PCT/KR2017/000555 filed on Jan. 17, 2017, which claims priority to Korean Application No. 10-2016-0005971 filed on Jan. 18, 2016, which applications are incorporated herein by reference.

BACKGROUND ART

1. Field of the Disclosure

Various embodiments of the present disclosure relate to a lightweight wall body frame used in the interior of a clean room.

2. Description of the Related Art

In general, a lightweight wall body used for partitioning the interior of a clean room requires a simple construction and a highly hermetical construction. In order to obtain rigidity of the lightweight wall body, it is common to configure the same such that a plurality of frames are provided therein, and such that coupling members are attached to the front and rear surfaces of coupling portions of the left and right frames and are then joined by screws in a connecting device of the frames, or such that a protrusion of the right frame is coupled to a recessed portion of the left frame and the gap of the coupling portion is caulked.

However, in the former case, many coupling accessories are required, and operators must work simultaneously at the front and back sides of the frame, which makes the construction difficult and inconvenient.

In the latter case, it is difficult to make a hermetical construction because the gap of the coupling portion tends to be easily opened. In particular, when each individual lightweight wall body is damaged or worn out, it is not easy to remove only the damaged wall individually, which causes a problem that the entire wall body must be reconstructed.

Therefore, there is demand for a lightweight wall body configuration in which the installation work is easy, only the damaged wall body can be easily removed and replaced, and the lightweight wall body can be reused after being demolished because no screw or the like is used on either side of the wall.

SUMMARY

A frame provided in the lightweight wall body is generally made in a rectangular shape for rigidity and is made of a rigid steel material, which causes shortcomings in which fabrication of the frame is complicated and the cost increases.

Therefore, various embodiments of the present disclosure can provide a lightweight wall body frame that secures the rigidity thereof by optimizing the shape of the frame and reduces the amount of material required for frame production, thereby reducing the cost and defective products and improving the quality of the product.

According to various embodiments of the present disclosure, a lightweight wall body frame may include: a frame body; a coupling portion configured to include a coupling opening formed at a center portion of the frame body; first and second attachment surfaces configured to be formed on the outer surfaces of the frame body so as to attach a steel plate of the lightweight wall body thereto; and first and second support portions configured to be formed in the frame body and configured to be formed to be inclined between the coupling portion and the first and second attachment surfaces so as to connect and support the same.

According to various embodiments of the present disclosure, since first and second support portions are formed to be inclined between frames made of an aluminum material in a frame body so as to connect and support the frames, it is possible to reduce the amount of aluminum required for the production and to facilitate production, thereby reducing the manufacturing cost of the product. A fall preventing portion provided in the frame body to prevent the frame body from falling down on the floor can improve the fixation force of the product. In addition, at least one adhesive overflow preventing portion is provided in the frame body to prevent an adhesive from overflowing when attaching a steel plate of the lightweight wall body using an adhesive, so that an adhesion failure of the product can be prevented. Further, a curved portion is formed to prevent the steel plate from being stuck or opened when the frame body and the steel plate are bonded, thereby improving the assembly of the product.

DETAILED DESCRIPTION

Figure 1:
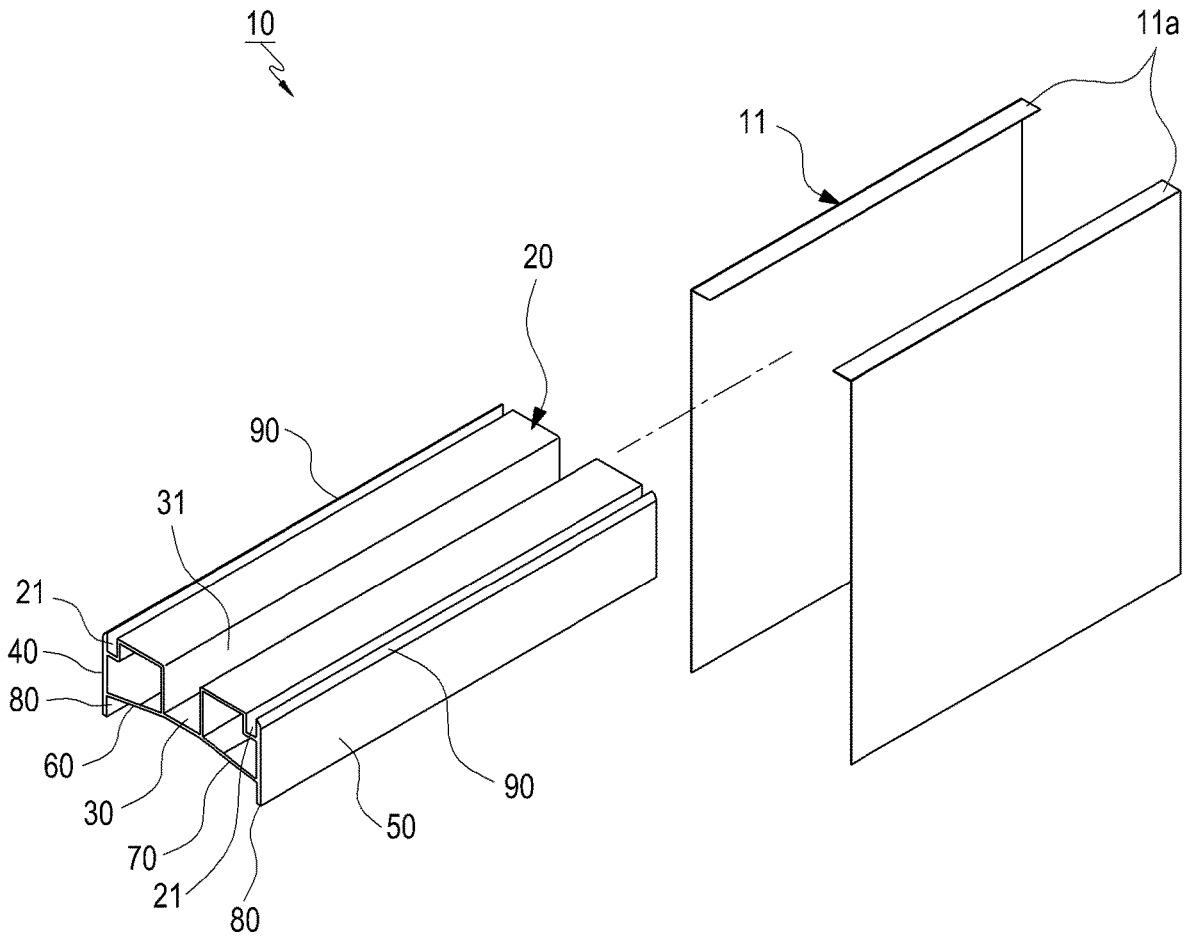
FIG. 1 is an exploded perspective view illustrating a configuration of a lightweight wall body frame according to an embodiment of the present disclosure.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expression "have", "may have", "include", or "may include" refers to the existence of a corresponding feature (e.g., numeral, function, operation, or constituent element such as component), and does not exclude one or more additional features.

In the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., Central Processing Unit (CPU) or Application Processor (AP)) that can perform the corresponding operations by executing one or more software programs stored in a memory device.

The terms used herein are merely for the purpose of describing particular embodiments and are not intended to limit the scope of other embodiments. A singular expression may include a plural expression unless they are definitely different in a context. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the present disclosure. In some cases, terms defined in this specification may not be interpreted as excluding embodiments of the present disclosure.

A lightweight wall body of various embodiments of the present disclosure may be used mainly as a partition panel of a clean room provided in semiconductor equipment, a hospital, or the like, and a plurality of frames may be provided inside the panel. A lightweight wall body of the present disclosure can be used as a partition panel for other purposes in addition to the clean room. For example, the lightweight wall body may be used as a partition for offices, homes, factories, or the like. In the embodiment of the present disclosure, the description will be made of a lightweight wall body and a lightweight wall body frame used in a clean room.

First, the configuration of a lightweight wall body frame 10, according to various embodiments of the present disclosure, will be described in detail.

Figure 2:
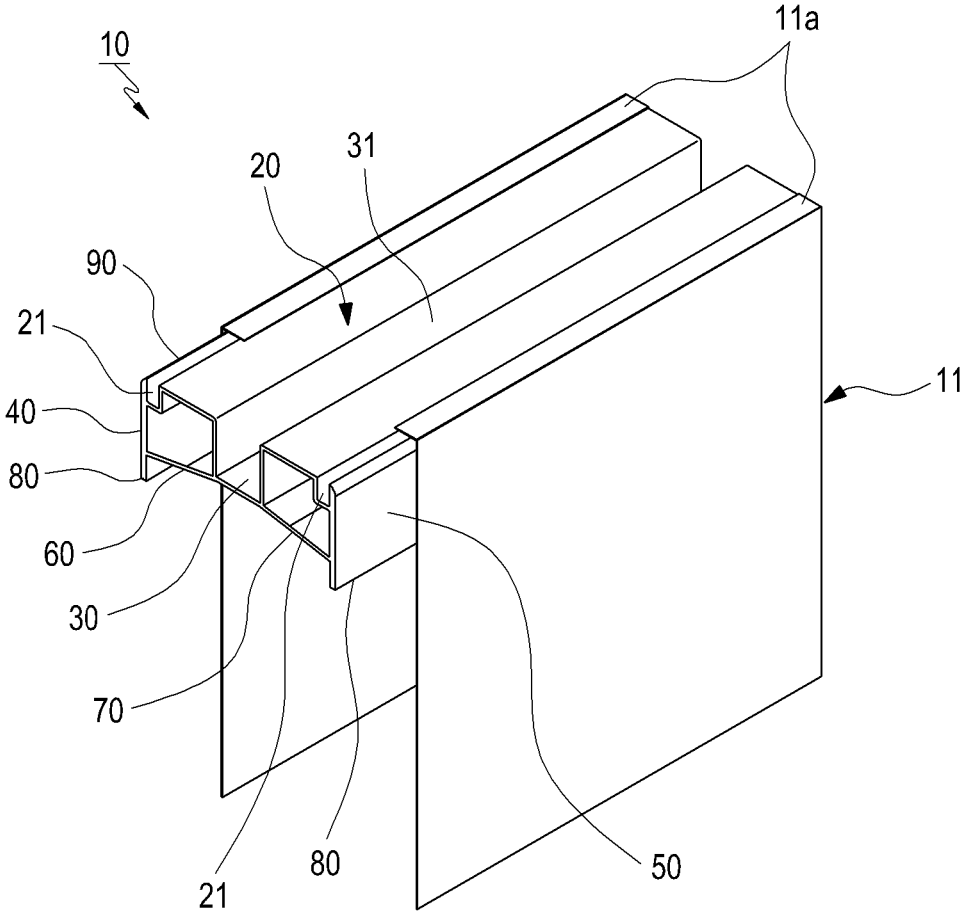
FIG. 2 is a perspective view illustrating a coupled state of a lightweight wall body frame according to an embodiment of the present disclosure.
Figure 3:
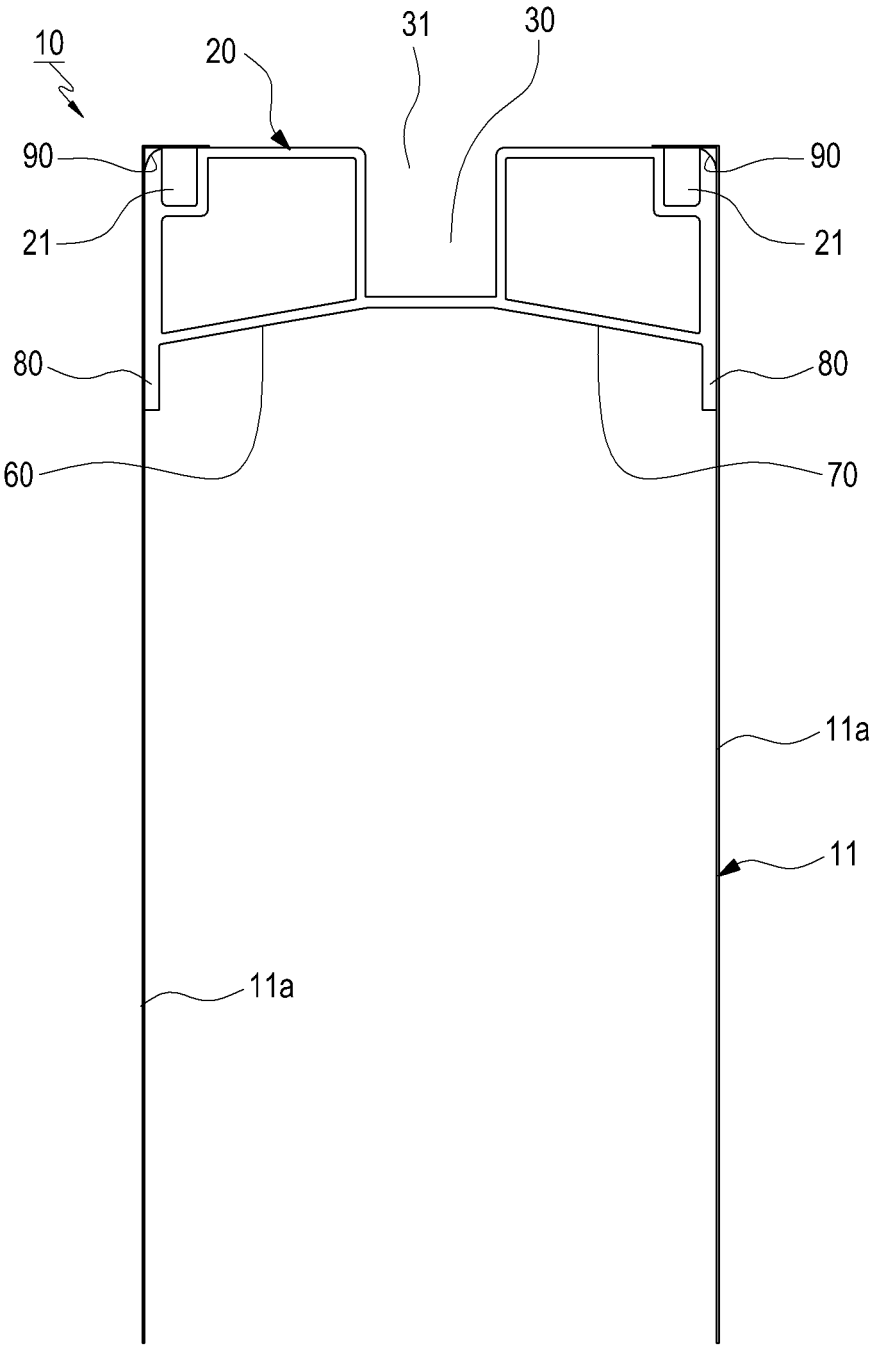
FIG. 3 is a side cross-sectional view illustrating a configuration of a lightweight wall body frame according to an embodiment of the present disclosure.

FIG. 1 is an exploded perspective view illustrating a configuration of a lightweight wall body frame 10 according to the present disclosure. FIG. 2 is a perspective view illustrating a coupled state of a lightweight wall body frame 10 according to the present disclosure. FIG. 3 is a side cross-sectional view illustrating a configuration of a lightweight wall body frame 10 according to an embodiment of the present disclosure.

Referring to FIGS. 1 to 3, a lightweight wall body frame 10 may include a frame body 20, a coupling portion 30, first and second attachment surfaces 40 and 50, and first and second support portions 60 and 70.

The frame body 20 may have a coupling portion 30, first second attachment surfaces 40 and 50, and first and second support portions 60 70, which will be described later.

The coupling portion 30 may be formed at the center portion of the frame body 20 so as to be connected with a connection portion 91 that connecting the lightweight wall body 11.

The coupling portion 30 may have a coupling opening 31 formed to allow the connection portion 91 to be inserted therein.

The first and second attachment surfaces 40 and 50 may be formed on the outer surfaces of the frame body 20 so as to attach a steel plate 11*a* of the lightweight wall body 11 thereto.

The first and second support portions 60 and 70 may be provided inside the frame body 20, and may be formed to be inclined between the coupling portion 30 and the first and second attachment surfaces 40 and 50 so as to couple and support the same.

For example, one ends of the first and second support portions 60 and 60 may be coupled to a lower portion of the coupling portion 30, and the opposite ends of the first and second support portions 60 and 70, which are formed to be inclined, may be coupled to the first and second attachment surfaces 40.

As described above, by providing the frame body 20 with the first and second support portions 60 and 70 formed to be inclined to support the coupling portion 30 and the first and second attachment surfaces 40 and 50, it is possible to reduce the amount of aluminum material used in the production of the product, thereby reducing the manufacturing cost of the product, and to facilitate the production of the product.

The frame body 20 may be made of an elongated bar-type frame, and may be inserted along the edges of the shape of the rectangular steel plate 11*a* to then be installed. For example, the frame body 20 may be inserted into upper, lower, and side edges of the rectangular steel plate 11*a*, and may then be installed to support the steel plate 11*a*.

For example, the frame body 20 will be described in more detail as follows.

As shown in FIG. 3, the frame body 20 may have at least one adhesive overflow preventing portion 21 formed therein to prevent an adhesive from overflowing when attaching the steel plate 11*a* of the lightweight wall body 11 to the first and second attachment surfaces 40 and 50 using the adhesive. For example, the adhesive overflow preventing portion 21 may be formed as a concave groove, so that an overflowing adhesive can flow into the groove. Therefore, the adhesive overflow preventing portions 21 configured as a concave groove can prevent the adhesive (not shown) from overflowing by receiving the adhesive therein.

As another example, fall preventing portions 80 may be provided in the lower portions of the first and second support portions 60 and 70 so as to prevent the frame body 20 from falling down on the floor. For example, the fall preventing portion 80 may be configured as a support column so as to stand on the floor.

As another example, curved portions 90 may be formed on one ends of the first and second attachment surfaces 40 and 50 so as to prevent the steel plate 11*a* from being stuck or opened when bonding one ends of the steel plate 11*a* of the lightweight wall body 11 to one ends of the first and second attachment surfaces 40 and 50. For example, the curved portions 90 may be formed to be curved on the outer surfaces of the upper ends of the first and second attachment surfaces 40 and 50 to then be bonded to the perpendicularly bent steel plate 11*a* so as to conform to the shape thereof. The first and second attachment surfaces 40 and 50 can prevent an adhesion failure with the steel plate 11*a* and the opening of the steel plate 11*a*.

The lightweight wall body frame 10 may be made of an aluminum material. In various embodiments of the present disclosure, although the lightweight wall body frame 10 is illustrated as being made of an aluminum material, but it is not limited thereto. That is, the lightweight wall body frame 10 can be made of various materials that can configure a lightweight wall body.

Now, the operation of the lightweight wall body frame 10, according to various embodiments of the present disclosure, will be described in detail.

Figure 4:
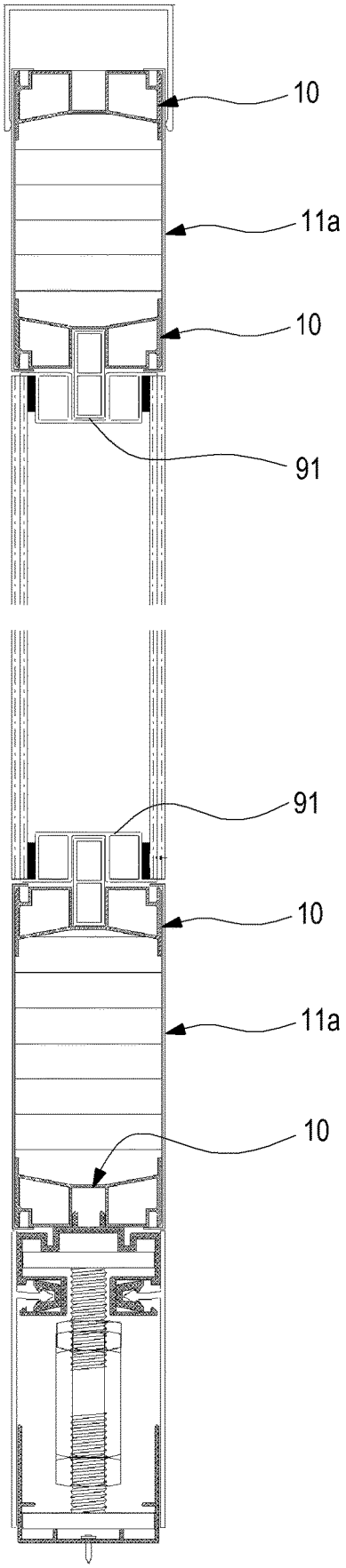
FIG. 4 is a side cross-sectional view illustrating a lightweight wall body frame in use according to an embodiment of the present disclosure.

FIG. 4 is a side cross-sectional view illustrating a lightweight wall body frame 10 in use according to an embodiment of the present disclosure.

As described with reference to FIG. 2, the frame body 20 may be installed on the upper, lower, and side edges of the rectangular steel plate 11*a* so as to support the steel plate 11*a*. Since one end of the steel plate 11*a* is bent at 90 degrees, the bent steel plate 11*a* is attached to the adhesive overflow preventing portion 21 of the frame body 20. Since the curved portions 90 are formed on one ends of the first and second attachment surfaces 40 and 50 so as to prevent the steel plate 11*a* from being stuck or opened when attaching the frame body 20 to one end of the steel plate 11*a*, the bent steel plate 11*a* may be attached to the adhesive overflow preventing portion 21 while being closely attached to the curved portion 90.

In addition, the side surfaces of the steel plates 11*a* are attached to the first and second attachment surfaces 40 and 50 of the frame body 20.

The lightweight wall body 11 produced as described above may be connected to another lightweight wall body 11 such that the sides thereof face each other. A connection portion 91 may be provided between the lightweight wall bodies 11 to connect the same. The connection portion 91 is provided between the lightweight wall bodies 11, and the connection portion 91 is coupled to the coupling portion 30 formed in the center portion of the frame body 20 to then be fixed. Accordingly, the lightweight wall bodies 11 can be coupled to each other. That is, the lightweight wall bodies 11 may be connected to each other to thus manufacture wall bodies of the above-mentioned clean room (not shown), thereby completing the clean room.

Since the lightweight wall body frame 10 manufactured as described above is made of an aluminum material and has the first and second support portions 60 and 70 formed to be inclined in order to reduce the amount of aluminum material, it is possible to reduce the manufacturing cost of the product and the construction cost of the clean room, thereby enhancing price competitiveness.

A configuration of a lightweight wall body frame 10, according to various other embodiments of the present disclosure, will now be described in detail.

Figure 5:
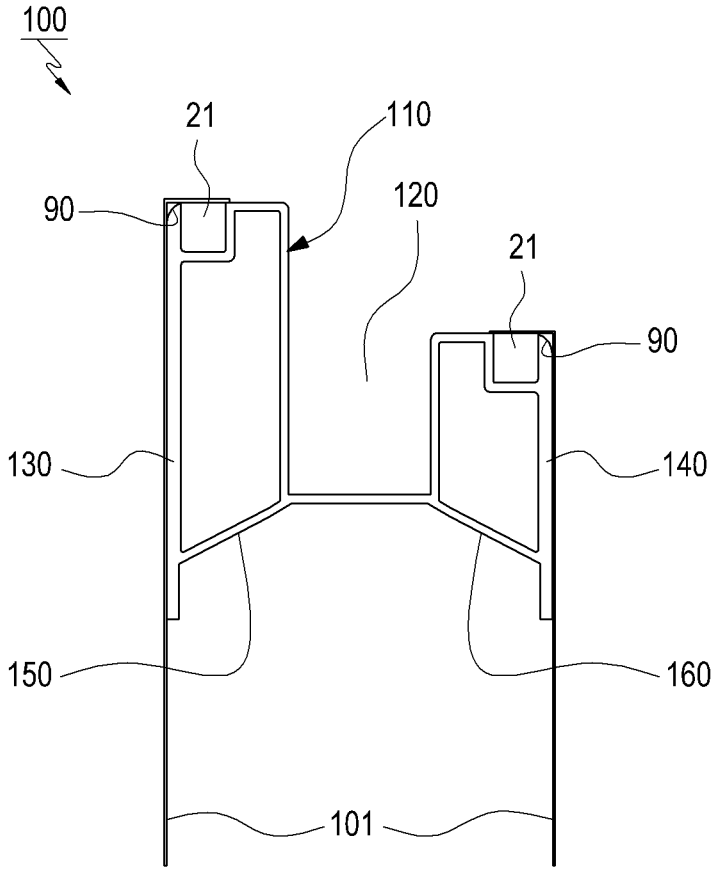
FIG. 5 is a side cross-sectional view illustrating a configuration of a lightweight wall body frame according to another embodiment of the present disclosure.
Figure 6:
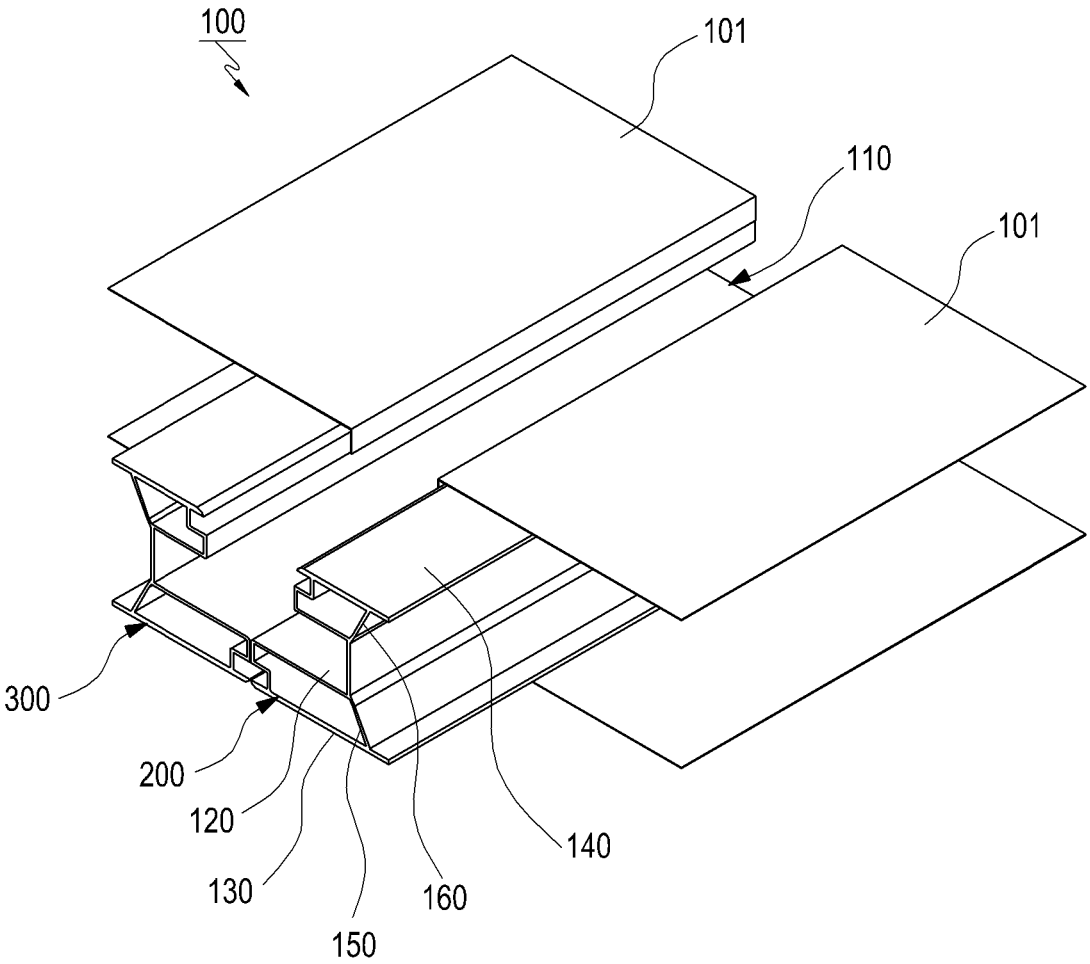
FIG. 6 is a perspective view illustrating a coupled state of a lightweight wall body frame according to another embodiment of the present disclosure.
Figure 7:
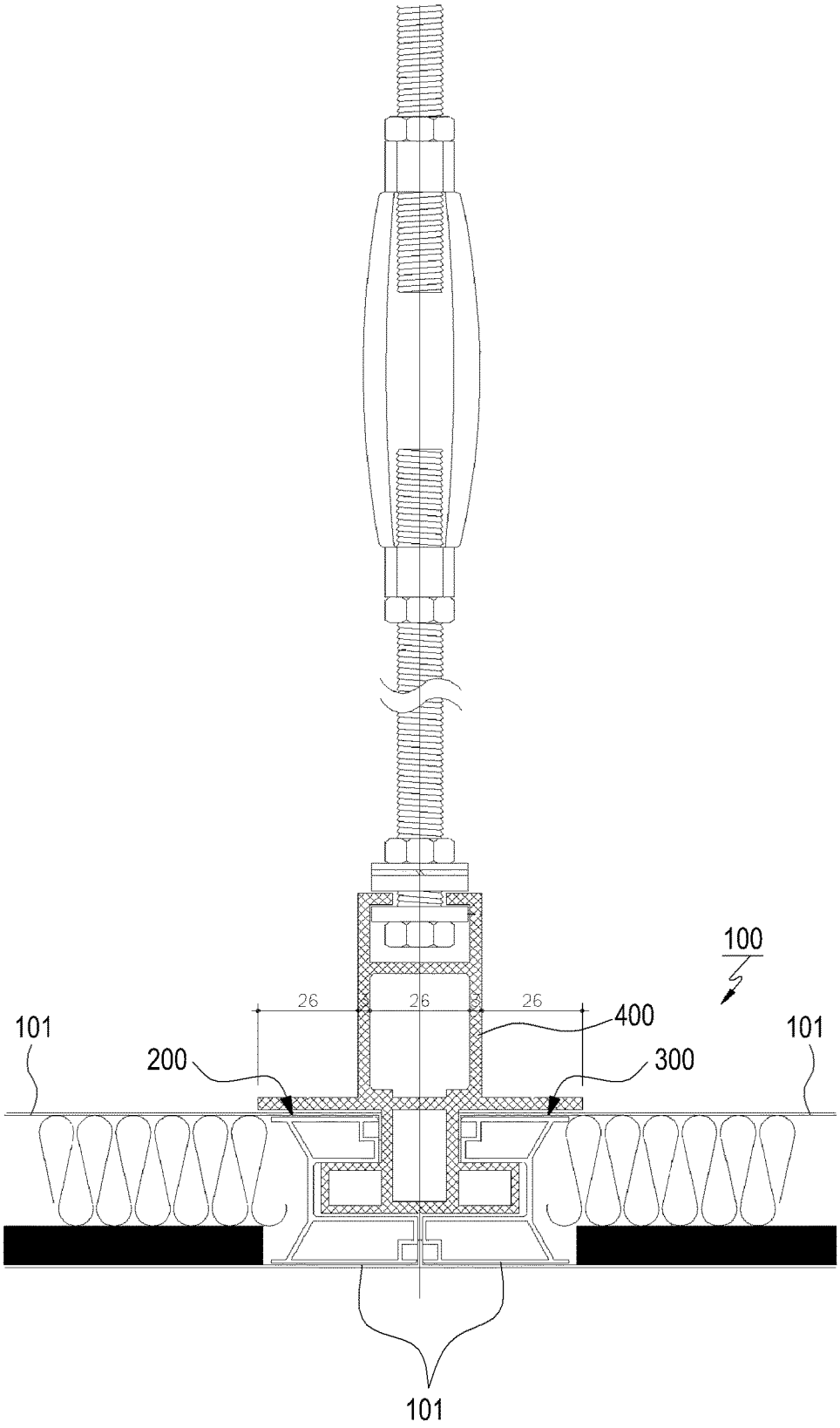
FIG. 7 is a side cross-sectional view illustrating a lightweight wall body frame in use according to another embodiment of the present disclosure.

FIG. 5 is a side cross-sectional view illustrating a configuration of a lightweight wall body frame 10 according to another embodiment of the present disclosure. FIG. 6 is a perspective view illustrating a coupled state of a lightweight wall body frame 10 according to another embodiment of the present disclosure. FIG. 7 is a side cross-sectional view illustrating a lightweight wall body frame 10 in use according to another embodiment of the present disclosure.

As shown in FIGS. 5 to 7, the lightweight wall body frame 100 may include a frame body 120, a coupling portion 130, first and second attachment surfaces 140 and 150, and first and second support portions 160 and 170.

The first attachment surface 140 may be formed to be longer than the second attachment surface 150. As another example, the second attachment surface 150 may be selectively formed to be longer than the first attachment surface 140.

As shown in FIG. 6, the lightweight wall body frame 100 includes first and second lightweight wall body frames 200 and 300, and steel plates 101 are attached to the first and second attachment surfaces 140 and 150 of the first and second lightweight wall body frames 200 and 300. In addition, the first and second lightweight wall body frames 200 and 300 are arranged to face each other. The long first attachment surface 140 of the first lightweight wall body 200 may be arranged to face the long first attachment surface 140 of the second lightweight wall body 300, and the second attachment surfaces 150, which are shorter than the first attachment surfaces 140, of the first and second lightweight wall bodies 200 and 300 may be arranged to face each other.

As shown in FIG. 7, a connection portion 400 of a lightweight wall body 101 may be inserted into a recessed portion formed between the respective second attachment surfaces 150 of the first and second lightweight wall bodies 200 and 300 to then be connected.

In addition, as shown in FIG. 5, the adhesive overflow preventing portion 21, the fall preventing portion 80, and the curved portion 91 formed in the lightweight wall body frame 100 have already been described in the previous embodiment, and thus the description thereof will be omitted.

While the present disclosure has been shown and described with reference to certain embodiments thereof, it will be apparent to those skilled in the art that the lightweight wall body frame according to the present disclosure is not limited to these embodiments, and various changes in form and details may be made therein without departing from the spirit and scope of the present disclosure as defined by the appended claims.

What is claimed is:

1. A lightweight wall body frame comprising:

a unitary frame body comprising;

a coupling member comprising a coupling groove formed at a center of the frame body, wherein the coupling groove is formed by two vertical members and a bottom member;

first and second attachment members constituting outer surfaces of the frame body;

first and second horizontal planar members, wherein the first horizontal planar member is connected between a top of one of the two vertical members and the first attachment member, and the second horizontal planar member is connected between a top of a remaining one of the two vertical members and the second attachment member; and first and second supporting members formed in the frame body, wherein the first supporting member is inclined with respect to the first attachment member and the second supporting member is inclined with respect to the second attachment member, the first supporting member connects the bottom member of the coupling groove to the first attachment member and the second supporting member connects the bottom member of the coupling groove to the second attachment member.

2. The lightweight wall body frame of claim 1, further comprising at least one adhesive overflow preventing member provided in the frame body so as to prevent an adhesive from overflowing when attaching a steel plate of the lightweight wall body to the first and second attachment members using the adhesive.

3. The lightweight wall body frame of claim 1, further comprising a fall preventing member provided at lower portions of the first and second supporting members so as to prevent the frame body from falling off.

4. The lightweight wall body frame of claim 1, wherein a curved portion is formed on an end of each of the first and second attachment members so as to prevent a steel plate of the lightweight wall body from being stuck or opened when bonding one end of the steel plate of the lightweight wall body to the end of each of the first and second attachment members.

5. The lightweight wall body frame of claim 1, wherein the lightweight wall body frame is made of an aluminum material.

6. The lightweight wall body frame of claim 1, wherein the first and second horizontal planar members are on a substantially same level.

7. The lightweight wall body frame of claim 6, wherein the first and second horizontal planar members are substantially parallel to the bottom member of the coupling groove.

8. The lightweight wall body frame of claim 1, wherein the first horizontal planar member is substantially perpendicular to the first vertical member and the second horizontal planar member is substantially perpendicular to the second vertical member.

9. A unitary frame body, comprising:

a coupling groove comprising two vertical plates and a bottom plate;

first and second outer plates;

first and second horizontal planar plates, wherein the first horizontal planar plate is connected between a top of one of the two vertical plates and the first outer plate, and the second horizontal planar plate is connected between a top of a remaining one of the two vertical plates and the second outer plate; and first and second supporting plates, wherein the first supporting plate is inclined with respect to the first outer plate and the second supporting plate is inclined with respect to the second outer plate, the first supporting plate connects the bottom plate of the coupling groove to the first outer plate and the second supporting plate connects the bottom plate of the coupling groove to the second outer plate.

10. The frame of claim 9, further comprising at least one adhesive overflow preventing member provided in the body so as to prevent an adhesive from overflowing when attaching a steel plate to the first and second outer plates using the adhesive.

11. The frame of claim 9, further comprising a fall preventing member provided at lower portions of the first and second supporting plates so as to prevent the body from falling off.

12. The frame of claim 9, wherein a curved portion is formed on an end of each of the first and second outer plates so as to prevent a steel plate of the body from being stuck or opened when bonding one end of the steel plate of the body to the end of each of the first and second outer plates.

13. The frame of claim 9, wherein the frame is made of an aluminum material.

14. The frame of claim 9, wherein the first outer plate is formed to be longer than the second outer plate, or the second outer plate is selectively formed to be longer than the first outer plate.

15. The frame of claim 9, wherein the first and second horizontal planar plates are on a substantially same level.

16. The frame of claim 15, wherein the first and second horizontal planar plates are substantially parallel to the bottom plate of the coupling groove.

17. The frame of claim 9, wherein the first horizontal planar plate is substantially perpendicular to the first vertical plate and the second horizontal planar plate is substantially perpendicular to the second vertical plate.

* * * * *